United States Patent [19]

Hollósy

[11] 4,447,057

[45] May 8, 1984

[54] TOY WITH BALLS

[75] Inventor: Lagos Hollósy, Budapest, Hungary

[73] Assignee: Generalimpex Kulkereskedelmi Vallalat, Budapest, Hungary

[21] Appl. No.: 334,721

[22] Filed: Dec. 28, 1981

[30] Foreign Application Priority Data

Jan. 5, 1981 [HU] Hungary ..... 11/81

[51] Int. Cl.[3] ..... A63F 7/04; A63F 7/02

[52] U.S. Cl. ..... 273/116; 273/121 E; 273/125 R

[58] Field of Search ..... 273/118–125, 273/108, 109, 110, 113, 115, 116

[56] References Cited

U.S. PATENT DOCUMENTS

| | | | |
|---|---|---|---|
| 772,281 | 10/1904 | Jurado | 273/120 R |
| 856,118 | 6/1907 | Wallace | 273/120 R |
| 2,010,266 | 8/1935 | Kemper et al. | 273/109 X |
| 2,145,846 | 2/1939 | Cannon | 273/125 A |
| 3,399,894 | 9/1968 | Smith | 273/115 |
| 3,582,074 | 6/1971 | Menotti | 273/125 A X |
| 3,865,377 | 2/1975 | Cooper et al. | 273/123 R X |
| 4,039,193 | 8/1977 | Slater et al. | 273/120 X |
| 4,190,251 | 2/1980 | Hall | 273/125 R X |
| 4,198,778 | 4/1980 | Morrison et al. | 273/123 R X |
| 4,248,427 | 2/1981 | Vierimaa | 273/113 X |

FOREIGN PATENT DOCUMENTS

| | | | |
|---|---|---|---|
| 140792 | 10/1934 | Austria | 273/120 R |
| 211283 | 2/1924 | United Kingdom | 273/120 R |

*Primary Examiner*—Paul E. Shapiro

*Attorney, Agent, or Firm*—Anthony H. Handal

[57] ABSTRACT

A toy with balls which is provided with a playing field. The playing field is formed on at least one rotatable disc (92), where the disc (2) is provided with holes (3), the size of which allows falling of the balls (4) freely therethrough. Furthermore it is provided with an assorting unit (6) connectible with the hole (3) of the disc (2), wherein the disc (2) is arranged in cup-shaped house (1) to be held in the hand having a cover (1*a*) and a side which are made of transparent material. The assorting unit (6) is firmly fixed. The assorting chamber (16) formed below the disc (2) and has as many guiding recesses (11) as the number of holes (3) of disc (2), and wherein the lower end of the guiding recesses (11) is connectible through outlets (17) of a rotatable null-setting disc (13) with a collecting space (18), which is in communication with a preparatory space (21) through channel (22), where a feeding key (23) is built in between the preparatory space (21) and playing space (9) above the disc (2).

3 Claims, 6 Drawing Figures

TOY WITH BALLS

The invention relates to toy with balls.

Countless toys with balls are known, divided into two groups according to the number of the balls—one or several—used for its operation. For example such toy with balls is known, which has two balls arranged in closed playing space. Solution of the game is given, when the player brings the balls into a fixed position, e.g. gates, by movement of the house.

The common characteristic of the know toys with balls is that their dependence on the dexterity of the player is minimal; luck has a decisive role in the solution, while the perception ability and logic of the player have hardly any role. Furthermore the playing time of such toys is short, consequently they hardly offer any particular excitement and experience to the player. These toys are not suitable fro playing in group.

The invention is aimed at elimination of above shortcomings.

The problem to be solved with the invention is to bring about such ball-type toy where the player can influence the result primarily by skill, perception ability and logic.

The problem according to the invention is solved with such ball-type toy, where the playing field is formed on one or several rotatable disc(s) provided with at least one hole, the size of which is suitable to let through the playing balls, and an assorting unit is connected with the hole of the disc.

The preferable further-development possibilities of the invention are described in the sub claims.

Figure 2:
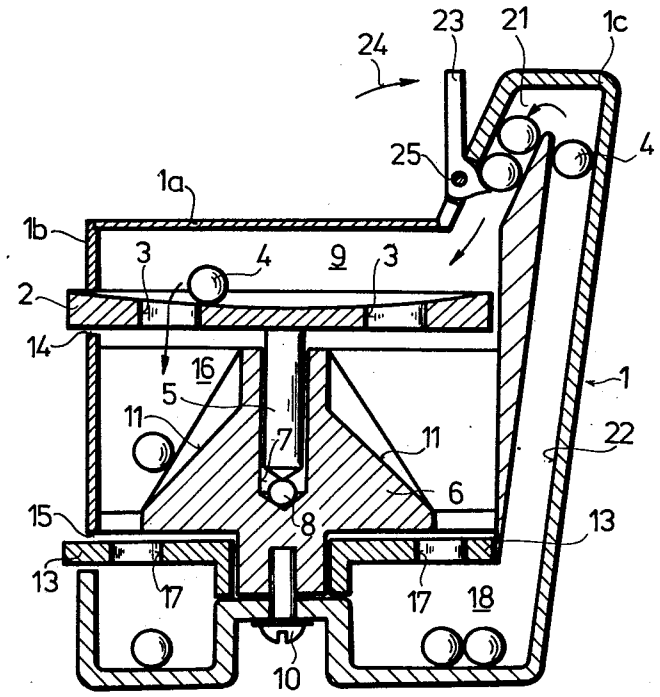
Figure 1:
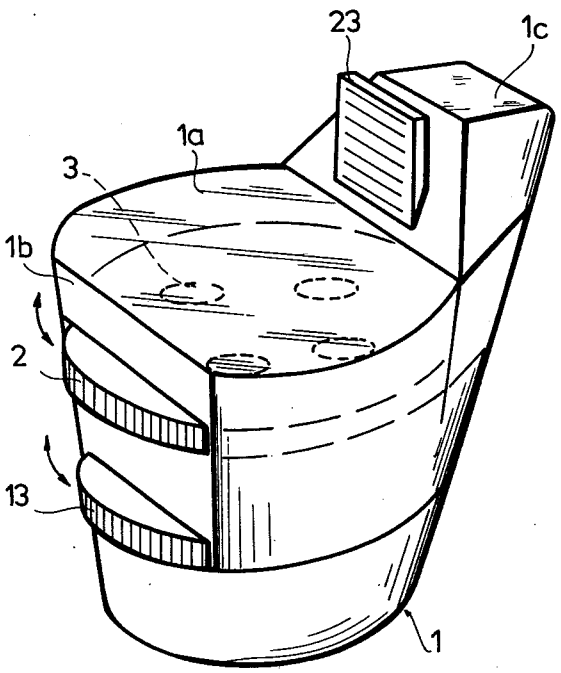
Figure 3:
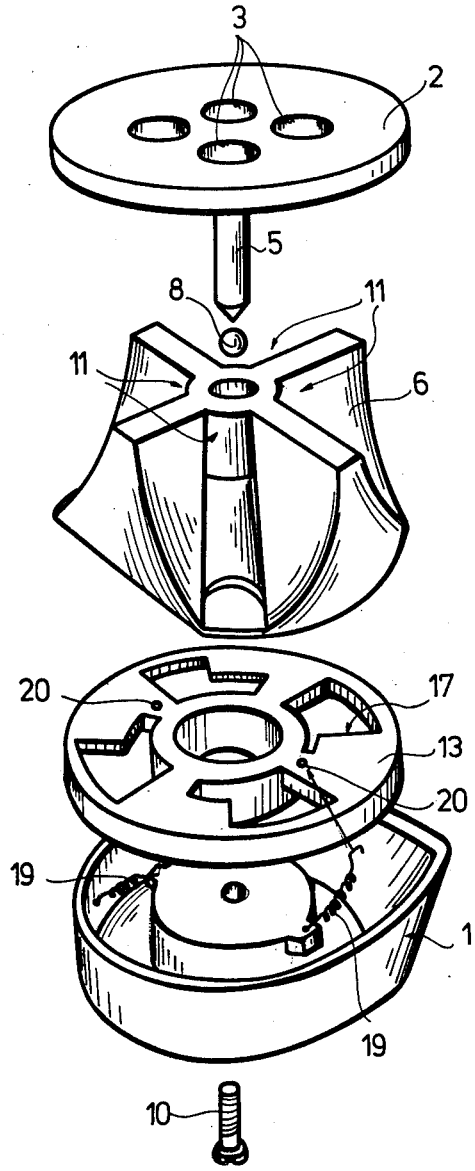
Figure 4:
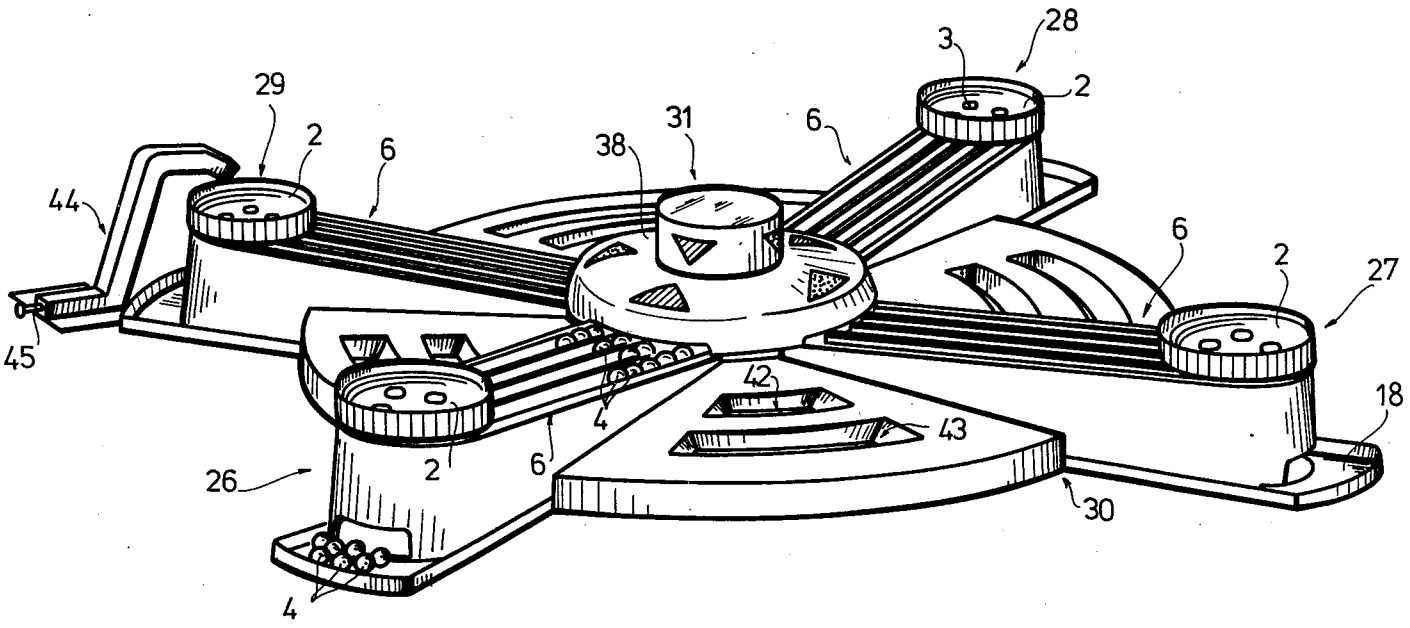
Figure 6:
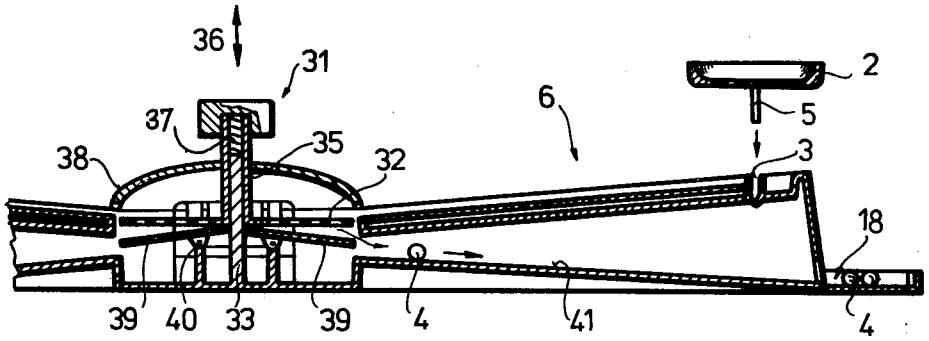
Figure 5:
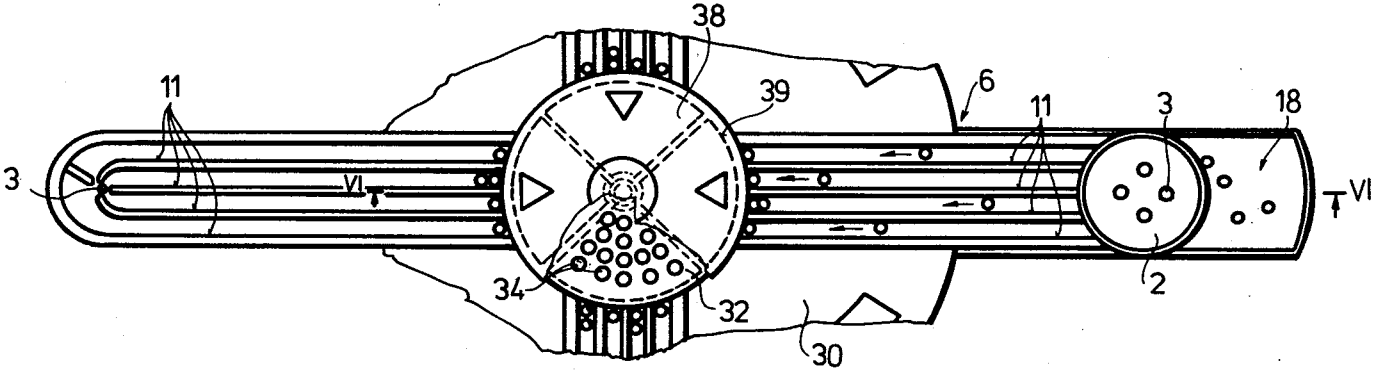

The invention is described in detail with the aid of drawing showing the construction of the toy according to the invention by way of two examples, in which:

FIG. 1.: Perspective view of the toy according to the invention given by way of the first example;

FIG. 2.: Cross section of the solution according to FIG. 1.;

FIG. 3.: Perspective-, exploded-view of the solution according to FIGS. 1 and 2., (showing detail of the house);

FIG. 4.: Perspective view of the toy according to the invention given by way of the second example;

FIG. 5.: Top view showing detail of the solution according to FIG.;

FIG. 6.: Section along line VI-VI shown in FIG. 5.

The toy with balls according to FIGS. 1–3., has cup-shaped house 1, the size of which allows its holding in the hand, the transparent cover of which is marked with reference number 1*a*. Two discs 2 freely rotatable around the vertical axis are arranged in the house 1, provided with vertical holes, in the present case with four holes 3. Diameter of the holes 3 is selected as to allow the falling through of balls 4 used as playing units. The disc 2 has a pin 5 embedded in a central blind hole 7 of an assorting unit 6. The pin 5 of the disc 2 is axially supported by a bearing ball 8.

In this case playing space 9 is formed between the disc 2 and the transparent cover 1*a*.

The lower part of the assorting unit 6 is fixed with a screw 10 to the bottom of the house 1. Furthermore the side-surface of the assorting unit 6 is provided with four guiding recesses 11. The lower cylindrical part of the assorting unit 6 has an extension 12 on which a null-setting disc 13 is rotatably arranged. The null-setting disc 13 and the disc 2 are parallel with each other, one end of both protrudes from the house 1 through openings 14 and 15 formed on a flattened front part 1*b* of the house 1. The side face of the house 1 between the disc 2 and the null-setting disc 13 is made similarly of transparent material.

Assorting chamber 16 is arranged in house 1 between the disc 2 and the null-setting disc 13. The null-setting disc 13 in this case has four outlets 17, through which balls 4 fall from the assorting chamber 16 into a lower collecting space 18 of the house 1, when these outlets 17 are arranged below the guiding recesses 11 of the assorting unit 6. For this purpose however the null-setting dis 13 has to be turned against springs 19 (FIG. 3.), since the null-setting disc 13 in its normal position prevents the balls 4 from falling down from the assorting chamber 16 into the collecting space 18. One end of the springs 19 is in contact with the bottom part of the house 1, while the other ends fit into holes 20 of the null-setting disc 13 (see FIG. 3.).

The collecting space 18 is connected with a preparatory space 21 formed on the extension 1*c* of the house 1 through a nearly vertical channel 22, the cross section of which is selected as to allow the free passage of the balls 4. From the preparatory space 21 formed as a sloping channel, the balls 4 can be passed one by one, or in group into the playing space 9 with the aid of a feeding key 23. The outer side of the extension 1 *c* opposite the feeding key 23 may be formed for instance as a frog-head, or cat-head. The feeding key 23 can be tipped around pin 25 in the direction of arrow 24, which—when tipped over from its locking position—clears the lower part of the preparatory space 21 and allows the fall of one or several balls 4 into the playing space 9.

Run of the playing with the toy according to the invention given by way of example in FIGS. 1–3., is the following:

Five balls 4 of red, blue, white and black colour are arranged in the collecting space 18. By turning the house 1 upside down, the balls 4 pass from the collecting space 18 through the channel 22 into the preparatory space 21. By pressing the feeding key 23 in the direction of the arrow 24, one of the balls 4 from the preparatory space 21 is dropped into the playing space 9, i.e. onto the disc 2. Meanwhile the disc 2 is turned to and fro, or spun as to have for example the red ball 4 falling through one of the holes 3, when it is just above the red guiding recess 11 of the assorting unit 6 which guides the red ball 4 into the assorting chamber 16. (Colour of the four guiding recesses 11 is the same as that of the four groups of balls,) Thus the perfect solution of the game occurs, when five red, five blue, five white and five black balls 4 out of the consecutively fed-in twenty balls 4 are admitted into the guiding recesses 11 of matching colour. Efficiency of the game depends first of all on the skill, perception ability and logic of the player. The result is given by how many of the differently coloured balls 4 can be brought into the matching coloured compartments of the assorting chamber 16.

When all the balls 4 took part in the game and the result is evaluated, the null-setting disc 13 is turned against the springs 19 until the outlets 17 are below the guiding recesses 11. At this point the balls 4 fall into the collecting space 18.

After releasing the null-setting disc 13 the game may be repeated in cycles.

The toy according to the invention as a game for four persons is shown in FIGS. 4–6., which is essentially the combination of the game shown in FIGS. 1–3., and suitable for the simultaneous game of four players. (The similar details are marked with the same reference numbers.)

The four playing units are marked with reference numbers 26–29 respectively. The four playing units 26–29 are arranged crosswise in a common house 30. Each playing unit 26–29 has a disc 2 formed here as flanged discs and provided with pin 5 and holes 3. One end of each assorting unit 6 is arranged below the discs 2. Each assorting unit 6 has four guiding recesses 11 sloping towards the centre of the house 30 which are open at the top, indicating the result too at the same time.

The guiding recesses 11 of the assorting units 6 are connected at the other ends with a central ball-contacting and returning unit 31.

The unit 31 has a perforated disc 32, moveable and rotatable in vertical direction around central pin 33 of the house 30. (FIGS. 5 and 6.) Each of the four 90° segments of the disc 32 is provided with sixteen holes 34, the diameter of which is selected as to allow the balls 4 falling through. The disc 32 has a cylindrical extension 35 to the upper end of which a control knob 36 is fixed. Compression spring 37 is built in between the upper end of the pin 33 and the control knob 36, keeping the disc 32 in the intermediate position as shown in FIGS. 5–6. The extension 35 of the disc 32 is led through the opening of a cover 38 fixed to the house 30. The disc 32 in its intermediate position—as shown in FIG. 6.—is in contact with the balls 4 rolling in the guiding recesses 11 towards the centre of the house 30.

In the present case four 90° segment-shaped tipping plates 39 are arranged below the disc 32, which are tiltable around a horizontal axis 40 perpendicular to the corresponding guiding recesses 11. The axis 40 is displaced in relation to the centre of gravity of the tipping plate 39, consequently the tipping plates 39 will tip over when the disc 32 is lifted.

Outward sloping return channel is formed below the guiding recesses 11 of each assorting unit 6 leading to a tray-shaped collecting space 18. The tipping plates 29 in their tipped over position guide the balls 4 into corresponding return channel 41.

In the interest of better demonstration the disc 2 is prominently shown in FIG. 6, while the disc 2 on the left hand side is omitted in FIG. 5.

The process of playing with the toy according to the invention as shown in FIGS. 4–6, is the following:

Each of the four players have five red, blue, white and black balls 4 in the collecting space 18. The player removes one or several balls 4 from the collecting space 18 and drops the ball(s) 4 onto the disc 2 while spinning or turning to and fro. The players aim at bringing about such motion of the ball 4 in the playing space of disc 2, as to have it falling through one of the holes 3, when it is just above the guiding recess 11 of matching colour. This is continued by the players as long as their stock of the balls 4 lasts. The result is obtained by counting the balls 4 in the guiding recesses 11 and by identification according to the colour (.i. e. how many balls 4 are in the guiding recess 11 of matching colour.)

Next upon pressing down the control knob 36 against the compression spring 37, the perforated disc 32 slightly descends, thereby inpact of the balls 4 is stopped and they can roll from the guiding recesses 11 onto the disc 32. The pressed down disc 32 swings the tipping plate 39 to nearly horizontal position, when they lie on the lower surface of the disc 32, thus preventing the balls 4 from falling through the holes 34 of the disc 32. When the central control knob 36 is turned, the balls 4 can be positioned in the holes 34 of the disc 32.

This is followed by slightly lifting the control knob 36 together with the disc 32. This results in tipping over the tipping plate 39, while the balls 4 falling through the holes 34 of the disc 32 are guided into the return channels 41. The return channels 41 return the balls 4 into the collecting space 18. Now the game may begin again.

According to FIG. 4., the house 30 may be provided with recesses 42, 43 for storage of the balls 4 (or chips not shown separately). The balls 4 can be dropped onto the disc 2 with a separate feeding unit 44, e.g. with the aid of a conventional spring-actuated slide valve 45.

The main advantage of the toy according to the invention is, that it gives lasting and exciting experience when playing either indiviaually, or in group. Furthermore in addition to the luck, the skill, perception ability and logic of the player play a significant role in the result. The toy according to the invention is recommended equally for children and adults, it can be used to advantage in gaming rooms, or casinos as well. Several rules of the game may be prepared for above described construction models, which are not being discussed here.

Several other constructions and combinations of the toy according to the invention are possible. Such construction is also conceivable, in which for instance the balls 4 are of the same colour, but each numbered hole 3 of disc 2 is provided with an electric sensor. In this case the player can determine in advance through which hole 3 is the ball 4 to be dropped, while the sensor of the selected hole 3 indicates the score. The functional surface of disc 2, i.e. the playing field may be provided with optional patter, configuration, or sloping, whereby the game can be made more difficult or easier. The degree of difficulty can be similarly influenced by arrangement of the holes 3. The disc 2 can be provided with separate revolving gear as well.

What we claim is:

1. Toy with balls and playing field wherein the playing field is formed on at least one rotatable disc (2), where the disc (2) is provided with at least one hole (3), the size of which allows falling of the ball freely through, furthermore it is provided with an assorting unit (6) connectible with the hole (3) of the disc (2), said disc (2) is arranged in cup-shaped house (1) to be held in the hand, cover (1a) and side of which are made of transparent material, furthermore the assorting unit (6) is firmly fixed in an assorting chamber (16) formed below the disc (2) and has as many guiding recesses (11) as the number of holes (3) of disc (2), the lower end of the guiding recesses (11) is connectible through outlets (17) of a rotatable null-setting disc (13) with a collecting space (18), which is in communication with a preparatory space (21) through channel (22), where a feeding key (23) is built in between the preparatory space (21) and playing space (9) above the disc (2).

2. Toy with balls and playing field wherein the playing field is formed on at least one rotatable disc (2), where the disc (2) is provided with at least one hole (3), the size of which allows falling of the ball freely through, furthermore, it is provided with assorting unit (6) connectible with the hole (3) of the disc (2), characterized in that the toy is formed as a game played in group having two or seveal playing units (26, 27, 28, 29), the assorting units (6) of which are connected with a central ball-contacting and returning unit (31).

3. Toy with balls as claimed in claim 2, characterized in that the central ball-cintacting and returning unit (31) has a vertically displaceable and rotatable disc (32), which has an intermediate position contacting the balls (4) in the guiding recesses (11) of the playing unit (26,27,28,29), said guiding recesses sloping towards the centre, as well as the disc (32) is provided with holes (34) for letting through the balls, furthermore tipping plates (39) are arranged below the disc (32), which in the lower position of the pressed down disc (32) block the bottom of the holes (34) of disc (32), while in the upper position of the disc (32) the balls falling through the holes (34) of the disc (32) are guided into return channels (41) leading into the collecting space (18).

* * * * *